US007089621B2

(12) United States Patent
Hohlbein

(10) Patent No.: US 7,089,621 B2
(45) Date of Patent: Aug. 15, 2006

(54) TOOTHBRUSH

(75) Inventor: Douglas J. Hohlbein, Pennington, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 10/870,462

(22) Filed: Jun. 18, 2004

(65) Prior Publication Data

US 2005/0000048 A1 Jan. 6, 2005

Related U.S. Application Data

(63) Continuation of application No. PCT/US03/30633, filed on Sep. 26, 2003, and a continuation-in-part of application No. 10/601,106, filed on Jun. 20, 2003, now abandoned, application No. 10/870,462, which is a continuation-in-part of application No. PCT/US03/29497, filed on Sep. 17, 2003, application No. 10/870,462, which is a continuation-in-part of application No. 29/189,729, filed on Sep. 10, 2003.

(60) Provisional application No. 60/419,425, filed on Oct. 18, 2002, provisional application No. 60/418,776, filed on Oct. 16, 2002, provisional application No. 60/414,117, filed on Sep. 27, 2002, provisional application No. 60/412,290, filed on Sep. 20, 2002.

(51) Int. Cl.
*A46B 9/04* (2006.01)

(52) U.S. Cl. ..... 15/110; 15/22.1; 15/167.1; 601/142

(58) Field of Classification Search ..... 15/22.1, 15/22.2, 110, 167.1, 28, 170; 433/127, 186; 601/139, 141, 142
See application file for complete search history.

(56) References Cited

U.S. PATENT DOCUMENTS 411,910 A 10/1889 Van Home
1,188,823 A 6/1916 Plank
1,191,556 A 7/1916 Blake
1,268,544 A 6/1918 Cates
1,405,279 A 7/1922 Cassedy
1,588,785 A 6/1926 Van Sant
1,598,224 A 8/1926 Van Sant
1,910,414 A 5/1933 Varga
1,924,152 A 8/1933 Coney et al.
2,059,914 A 11/1936 Rosenberg
2,083,217 A 6/1937 Brother et al.
2,088,839 A 8/1937 Coney et al.
2,161,349 A 6/1939 Hadden
2,186,005 A 1/1940 Casto
2,305,461 A * 12/1942 Spyra ..... 15/167.1
2,312,828 A 3/1943 Adamsson
2,364,205 A * 12/1944 Fuller ..... 601/141
2,443,461 A 6/1948 Kempster
2,545,814 A 3/1951 Kempster (Continued)

FOREIGN PATENT DOCUMENTS

EP 0449655 B1 5/1995

(Continued)

*Primary Examiner*—Gladys JP Corcoran
*Assistant Examiner*—Shay Balsis
(74) *Attorney, Agent, or Firm*—Harris A. Wolin

(57) ABSTRACT

A toothbrush includes a head and a plurality of tooth cleaning elements for enhanced cleaning of the teeth. The tooth cleaning elements include cleaning elements that define a loop arrangement for better retention of the dentifrice, a central cleaning element disposed within the loop, two opposing arcuate cleaning elements disposed on opposite sides of the loop, peripheral cleaning element with a stepped and tapered construction, elongate distal cleaning elements, and proximal cleaning elements.

33 Claims, 5 Drawing Sheets

U.S. PATENT DOCUMENTS 2,637,870 A 5/1953 Cohen
3,153,800 A 10/1964 Trotin
3,195,537 A 7/1965 Blasl
3,261,354 A 7/1966 Shpuntoff
3,638,270 A 2/1972 Schlegel, Jr. et al.
4,249,521 A 2/1981 Gueret
4,277,862 A 7/1981 Weideman
4,292,705 A 10/1981 Stouffer
D272,683 S 2/1984 Stocchi
D272,687 S 2/1984 Stocchi
D272,689 S 2/1984 Stocchi
D272,690 S 2/1984 Stocchi
D273,635 S 5/1984 Stocchi
4,455,704 A 6/1984 Williams
4,461,285 A 7/1984 Courtin
4,493,125 A 1/1985 Collis
4,592,108 A 6/1986 Svendsen
4,607,411 A 8/1986 Lewis, Jr.
4,827,557 A 5/1989 Siler, Jr. et al.
5,120,225 A 6/1992 Amit
5,242,235 A 9/1993 Li
5,305,489 A 4/1994 Lage
5,373,600 A 12/1994 Stojanovski et al.
5,392,483 A 2/1995 Heinzelman et al.
5,396,678 A 3/1995 Bredall et al.
5,446,940 A 9/1995 Curtis et al.
5,570,487 A 11/1996 Schneider
5,584,690 A 12/1996 Maassarani
5,604,951 A 2/1997 Shipp
5,628,082 A 5/1997 Moskovich
D386,905 S 12/1997 Brady et al.
5,729,858 A 3/1998 Riffel
5,735,011 A 4/1998 Asher
5,735,864 A 4/1998 Heisinger, Jr.
5,778,475 A 7/1998 Garcia
5,809,608 A 9/1998 Zadro
D402,116 S 12/1998 Magloff et al.
D403,510 S 1/1999 Menke et al.
5,875,510 A 3/1999 Lamond et al.
5,896,614 A 4/1999 Flewitt
5,930,860 A 8/1999 Shipp
5,930,861 A 8/1999 White
5,970,564 A 10/1999 Inns et al.
5,974,614 A 11/1999 Ross
6,041,467 A 3/2000 Roberts et al.
6,041,468 A 3/2000 Chen et al.
D422,143 S 4/2000 Beals et al.
D424,808 S 5/2000 Beals et al.
D425,306 S 5/2000 Beals et al.
6,098,233 A 8/2000 Chen
6,105,191 A 8/2000 Chen et al.
6,108,851 A 8/2000 Bredall et al.
6,119,296 A 9/2000 Noe et al.
D440,767 S 4/2001 Moskovich et al.
6,260,227 B1 * 7/2001 Fulop et al. ..... 15/167.1
6,276,021 B1 8/2001 Holhbien
D450,929 S 11/2001 Angelini et al.
6,311,358 B1 11/2001 Soetewey et al.
6,319,332 B1 11/2001 Gavney, Jr. et al.
6,374,448 B1 4/2002 Seifert
6,389,634 B1 5/2002 Devlin et al.
D461,959 S 8/2002 Chan et al.
6,446,295 B1 9/2002 Calabrese
6,463,618 B1 10/2002 Zimmer
6,463,619 B1 10/2002 Gavney, Jr.
6,496,999 B1 12/2002 Gleason et al.
6,513,182 B1 2/2003 Calabrese et al.
6,546,586 B1 4/2003 Cho
D483,568 S 12/2003 Jamson
6,658,688 B1 12/2003 Gavney, Jr.
6,859,969 B1 * 3/2005 Gavney et al. ..... 15/117
2001/0042280 A1 11/2001 Moskovich et al.
2002/0124333 A1 9/2002 Hafliger et al.
2002/0138928 A1 10/2002 Calabrese et al.
2003/0196283 A1 10/2003 Gatzemeyer et al.
2003/0208865 A1 11/2003 Davies
2003/0229959 A1 12/2003 Kim et al.
2004/0025275 A1 2/2004 Moskovich et al.
2004/0068810 A1 4/2004 Lee

FOREIGN PATENT DOCUMENTS

EP 1308108 5/2003
GB 2371217 7/2002
JP 51 35303 8/1976
JP 9-182626 7/1997
JP 10-42957 2/1998
WO WO 97/03587 2/1997
WO WO 1998/05241 A 2/1998
WO WO 99/01054 1/1999
WO WO 99/07251 2/1999
WO WO 2003/030680 A 4/2003
WO WO 2004/019801 A 3/2004

* cited by examiner

TOOTHBRUSH

CROSS-REFERENCE TO RELATED APPLICATIONS

This application is a continuation in part of U.S. patent application Ser. No. 10/601,106 filed Jun. 20, 2003, abandoned, entitled "Toothbrush with Tongue Cleaning Member", and is a continuation in part of U.S. PCT application Ser. No. PCT/US2003/030633 (designating the U.S.) filed Sep. 26, 2003, entitled "Toothbrush", which claims priority to U.S. Patent Application No. 60/414,117, filed Sep. 27, 2002 (now abandoned), U.S. Patent Application No. 60/418,776, filed Oct. 16, 2002 (now abandoned) and U.S. patent application Ser. No. 60/419,425, filed Oct. 18, 2002 (now abandoned), and is, a continuation in part of PCT patent application No. PCT/US2003/029497 (designating the U.S.), filed Sep. 17, 2003, entitled "Toothbrush With Gripping Area", which claims priority to U.S. Provisional Patent Application Ser. No. 60/412,290, filed Sep. 20, 2002 (now abandoned), and is a continuation in part of U.S. Patent Application Ser. No. 29/189,729, filed Sep. 10, 2003. This application is also related to U.S. Patent Application Ser. No. 10/869,922 entitled "Oral Care Implement" filed on the same date herewith. The contents of the above-noted applications are each expressly incorporated herein by reference.

FIELD OF THE INVENTION

The present invention pertains to a toothbrush with an enhanced cleaning head.

BACKGROUND OF THE INVENTION

A toothbrush is used to clean the teeth by removing plaque and debris from the tooth surfaces. Conventional toothbrushes provided with a flat bristle trim are limited in their ability to conform to the curvature of the teeth, to penetrate into the interproximal areas between the teeth, to sweep away the plaque and debris, and to clean along the gum line. Additionally, such toothbrushes have a limited ability to retain dentifrice for cleaning the teeth. During the brushing process, the dentifrice typically slips through the tufts of bristles and away from the contact between the bristles and the teeth. As a result, the dentifrice often is spread around the mouth, rather than being concentrated on the contact of the bristles with the teeth. Therefore, the efficiency of the cleaning process is reduced.

SUMMARY OF THE INVENTION

The invention pertains to a toothbrush with a novel arrangement of cleaning elements to provide superior cleaning of the teeth.

In one aspect of the invention, a toothbrush includes a head having a plurality of tooth cleaning elements extending from a base surface. The tooth cleaning elements generally define a loop arrangement to better retain the dentifrice proximate to the contact between the bristles and the teeth for more effective cleaning. In one preferred construction, each loop is formed by a plurality of independently flexible cleaning elements so as to maintain user comfort and provide improved cleaning of the teeth.

In another aspect of the invention, other cleaning elements are disposed within the cleaning elements forming the loop. In this construction, these central cleaning elements are strategically located to maximize the cleaning effect of the retained dentifrice.

In another aspect of the invention, tooth cleaning elements are positioned along the periphery of the head. In one preferred construction, these peripheral cleaning elements are stepped and tapered to clean along the gum line and reach the interproximal areas between the teeth.

The present invention also pertains to combinations of different kinds of cleaning elements on a single head that cooperate to provide a pattern for overall improved cleaning of the teeth, including effective cleaning of the rear teeth, the interproximal areas between the teeth, along the gum line, and the lingual and facial side surfaces of the teeth.

BRIEF DESCRIPTION OF THE DRAWINGS

A more complete understanding of the present invention and the advantages thereof may be acquired by referring to the following description in consideration of the accompanying drawings, in which like reference numbers indicate like features, and wherein.

DETAILED DESCRIPTION OF THE INVENTION

Figure 1:
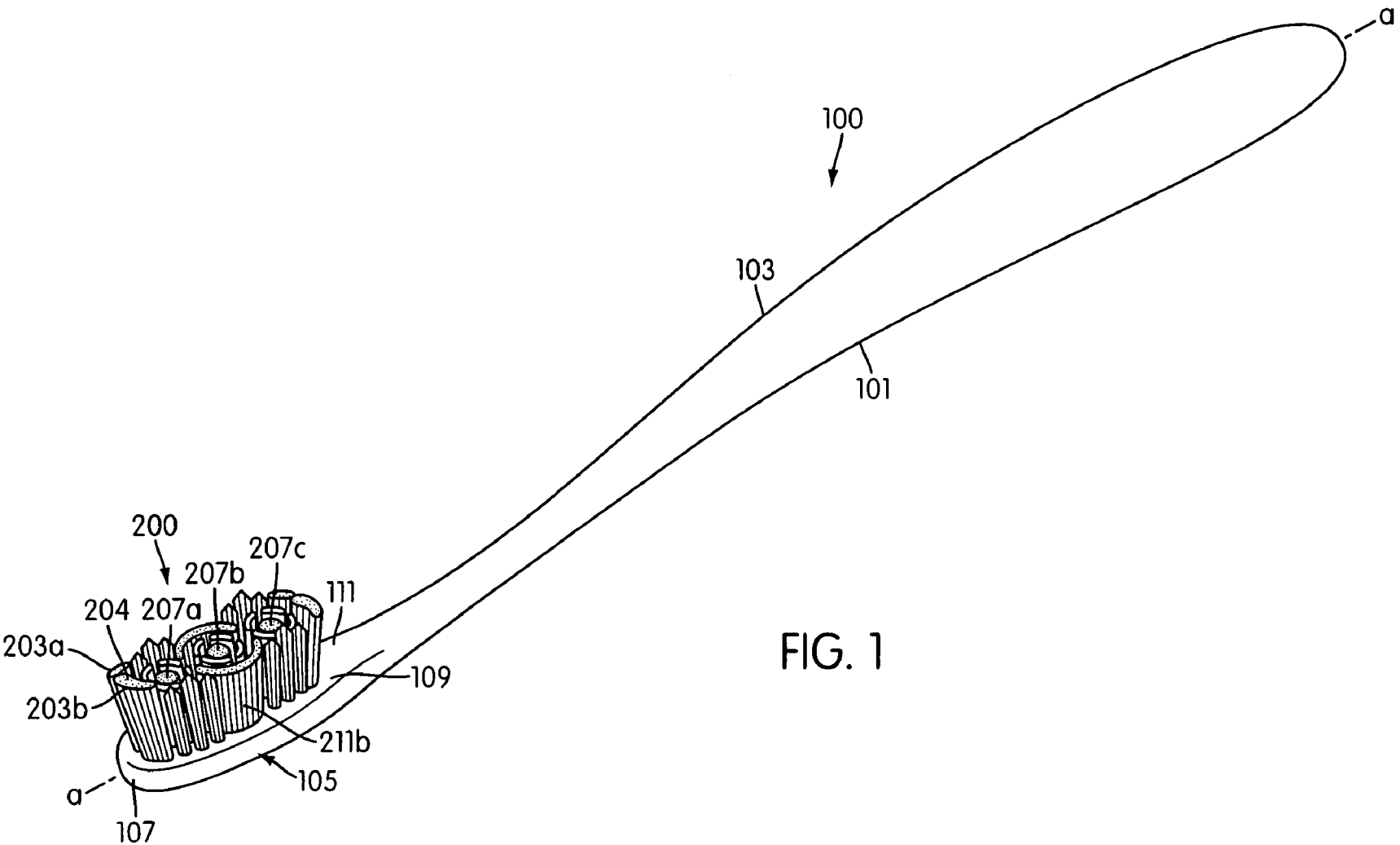
FIG. 1 is a perspective view of a toothbrush according to one or more aspects of an illustrative embodiment.

FIGS. 1–7 illustrate a toothbrush 100 having a support 101 including a handle 103 and a head 105, and tooth cleaning elements 200 for cleaning the user's teeth. Handle 103 is provided for the user to readily grip and manipulate the toothbrush 100, and may be formed of many different shapes and with a variety of constructions. Head 105 is the end portion of the support provided with tooth cleaning elements 200. The tooth cleaning elements can be attached to a base surface 109 of head 105 by any known means.

In a preferred construction, base surface 109 is provided with at least one group of cleaning elements 209 that collectively define a loop configuration 214 to better retain dentifrice among the tooth cleaning elements 200 and specifically between the contact of the cleaning elements and the teeth. While the loop configuration is preferably a circle, it could be in the form of a myriad of different closed loops including without limitation ovals, squares and irregular shapes. It is believed that the use of interior concave wall surfaces within the loop will best retain and move the dentifrice on the teeth especially when the toothbrush is generally moved in the desired small circular motions to brush the teeth. Nevertheless, other shapes can be used. The loop should simply define a substantially closed configuration to retain the dentifrice.

Figure 2:
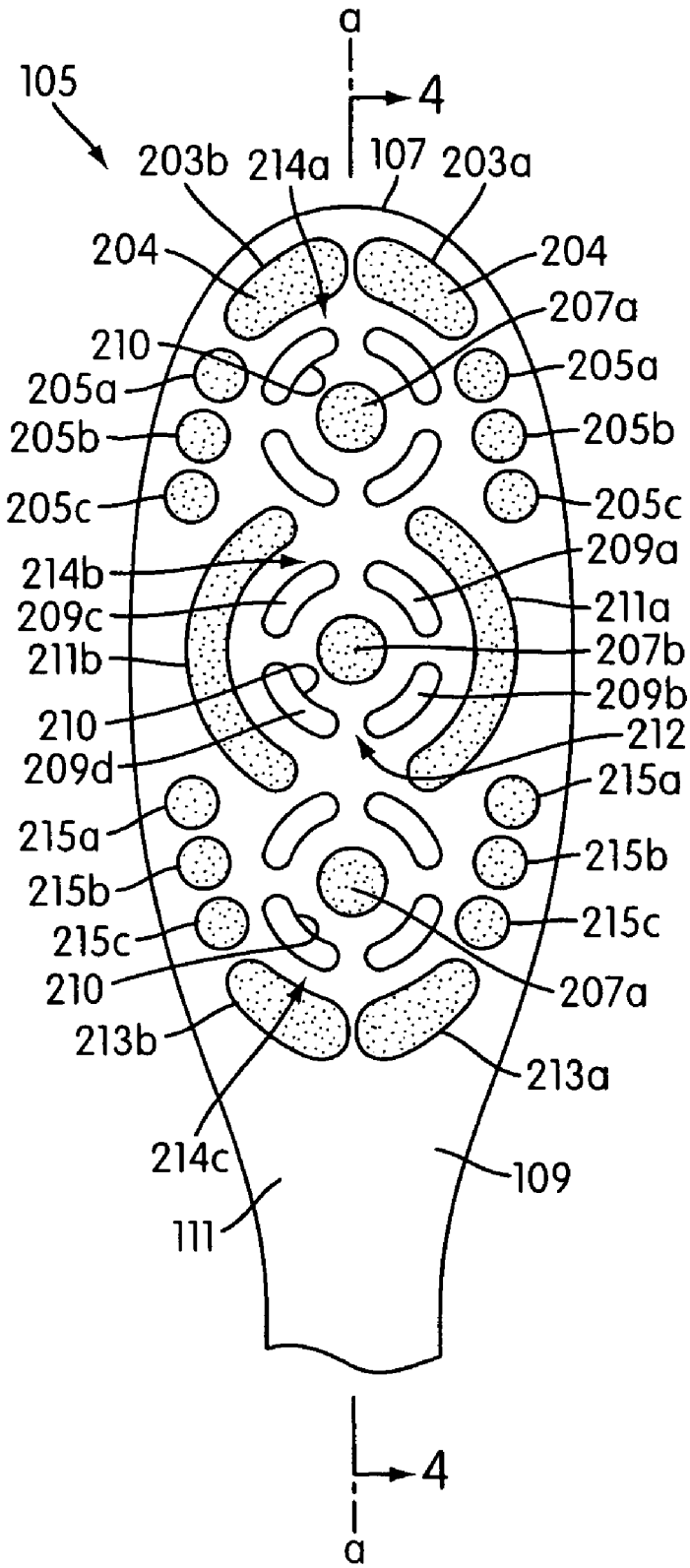
FIG. 2 is an enlarged plan view of a head section of the toothbrush of FIG. 1.

To better retain the dentifrice, each loop configuration is preferably defined by cleaning elements composed of elastomeric wall members. Although the loop configurations could be formed by tightly packed, elongate bristle tufts, such arrangements will permit a greater escape of the dentifrice than the elastomeric wall members. Further, although the loop configurations could be completely closed structures, they are preferably only substantially closed and each formed by a plurality of independently flexible cleaning elements 209*a–d*. In this way, the cleaning elements are able to provide a limited and controlled flow of the dentifrice to the outer cleaning elements and maintain sufficient flexibility to provide greater user comfort and improved cleaning by elements 209. In the preferred construction, as seen in FIG. 2, each loop construction is defined by four elastomeric wall members 209*a–d* each defining an arc segment that is approximately a quarter of a circle. As noted above, adjacent arc segments are spaced apart to define gaps 212 that permit a limited outward flow of dentifrice and independent flexing of each wall member. The gaps also aid the cleaning of cleaning elements 209 by permitting water to flush through the loops. The gaps, however, are preferably kept small to limit the escape of the dentifrice. While four segments have been illustrated to define each loop, other numbers of segments could be used. The wall members can be formed of any elastomeric material known for use as tooth cleaning elements. Finally, although the arc segments are preferably independent cleaning members, the loop could also be formed as a single member provided with slits to define gaps 212 and independently flexible cleaning elements 209*a–d*.

As best seen in FIG. 2, the preferred embodiment includes three loops 214*a–c* that are each positioned front to back along longitudinal axis a—a. In this way, a large portion of the dentifrice applied to the tooth cleaning elements can be retained to clean the user's teeth. Nevertheless, one, two or more than three loops could be used. Moreover, the loops could be arranged in other patterns including non-aligned arrangements or positioned off of axis a—a.

In a preferred construction, a central cleaning element 207 is disposed within each loop 214; although more than one central cleaning element 207 could be provided within each loop when larger loops are used. With this arrangement, dentifrice stays near the tips of cleaning elements 207 during a brushing operation for efficient cleaning. In the preferred construction, the concave nature of the inside surfaces of cleaning elements 209*a–d* directs the dentifrice to cleaning elements 207*a–c* during the sweeping or oscillating motion of head 105.

Central cleaning elements 207 are each preferably formed as bristle tufts for effectively cleaning the teeth. Nevertheless, one or more elastomer members may be used to form the distal cleaning elements in lieu of or in addition to the use of bristles.

The bristles of cleaning elements 203 as well as the bristles of other tufts discussed below are preferably composed of a nylon made from a material such as, for example, a nylon material marketed by Dupont under the name BRILLIANCE. Nevertheless, other materials could be used. The bristles in toothbrush 100 also preferably have a circular cross-sectional shape, but could have other cross-sections as well. The round bristles in toothbrush may be composed on a nylon marketed by Dupont under the name of TYNEX. The diameter of the round bristles are preferably 0.007 inches–0.008 inches thick or have other thicknesses depending on the desired cleaning action of the bristles. The tooth cleaning elements are connected to the toothbrush using known manufacturing methods for oral care products.

With reference to FIGS. 1 and 2, an additional outer ring of cleaning elements 211*a*, 211*b* is disposed in a central region of head 105 in a generally arcuate arrangement about cleaning elements 209*a–d* of central loop 214*b*. These outer arcuate cleaning elements 211*a–b* are preferably defined by two opposing arcuate cleaning elements which are arranged generally symmetrical on each side of the longitudinal axis a—a of head 105. As shown in FIG. 2, the outer cleaning elements 211*a–b* surround the loop cleaning elements 209*a–d* in the central region of head 105 to effectively use this space on the head. In a preferred arrangement, the loop cleaning elements 209*a–d* in the central region may be disposed generally concentrically within outer cleaning elements 211*a–b*. The dentifrice flowing through gaps 212 in the sides of loop 214*b* will be used by outer cleaning elements 211. While the outer arcuate cleaning elements 211*a, b* are preferably defined by elongate bristle tufts for effective brushing of the teeth, they could be formed of one or more elastomeric members in lieu of or in addition to the bristles.

Figure 4:
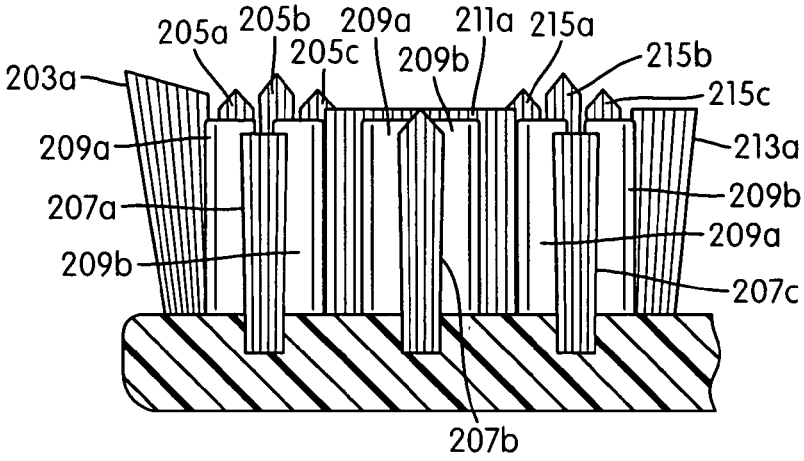
FIG. 4 is a section view of the head section taken along line 4—4 in FIG. 2.
Figure 5:
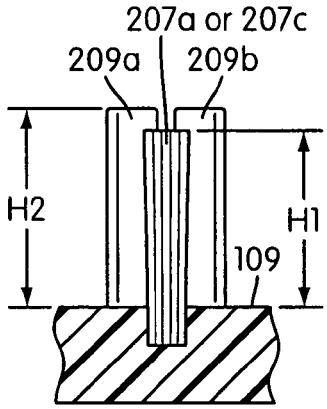
FIG. 5 is a partial section view of the head section similar to FIG. 4 showing a tooth cleaning element arrangement in isolation for clarity.
Figure 6:
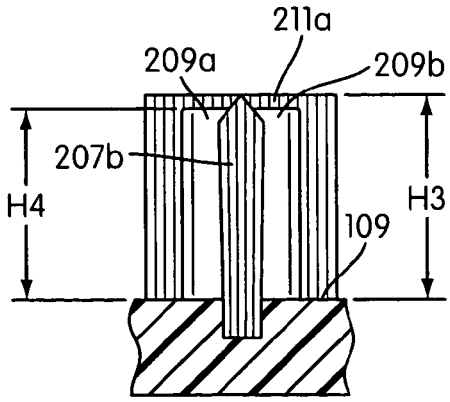
FIG. 6 is a partial section view of the head section similar to FIG. 4 showing another tooth cleaning element arrangement in isolation for clarity.
Figure 7:
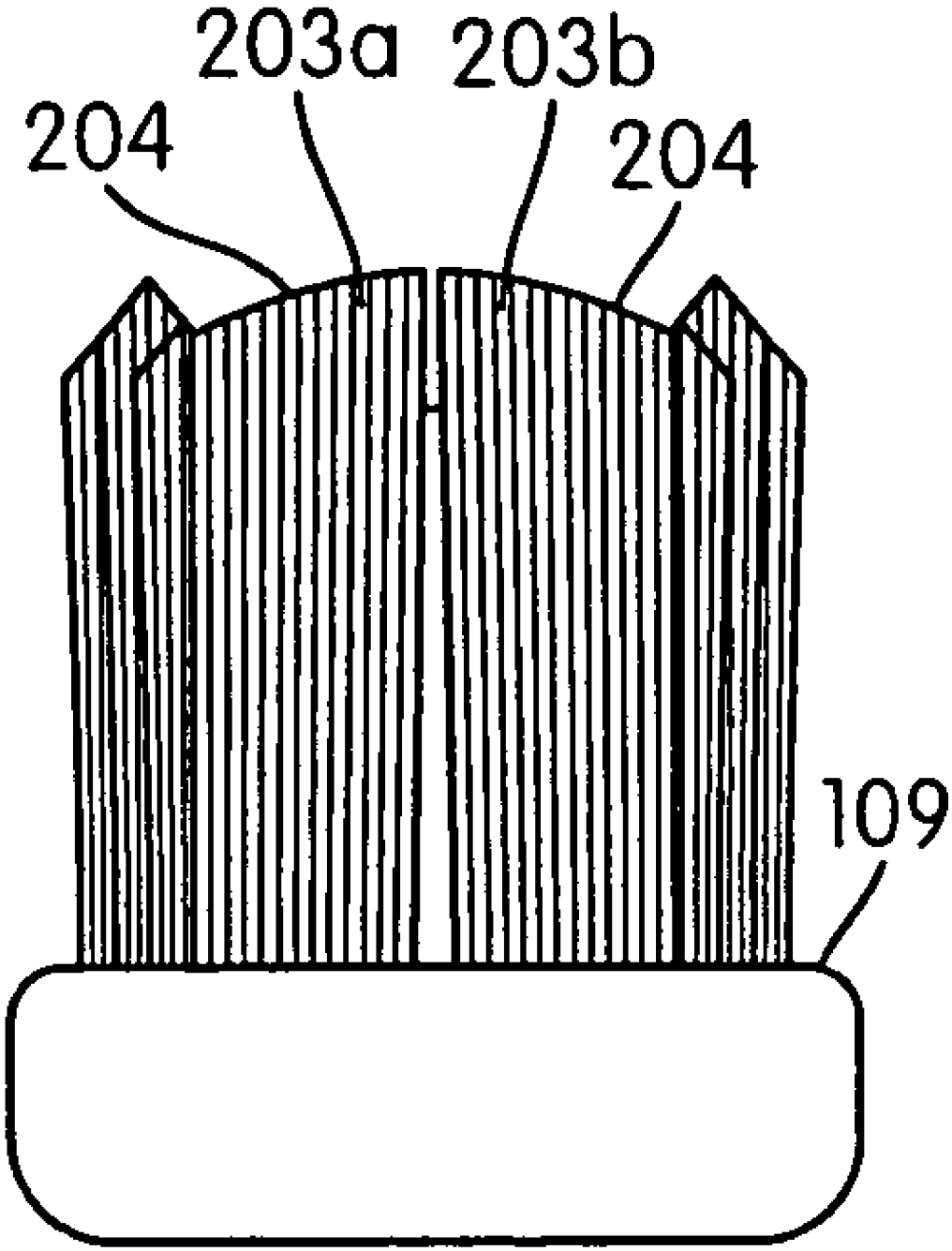
FIG. 7 is a distal end view of the head section of the toothbrush of FIG. 1.

FIGS. 4–6 are sectional views of head 105 that reveal the preferred height characteristics of cleaning elements 207, 209 and 211. In the preferred construction, central cleaning elements 207*a* and 207*c* are shorter than cleaning elements 209 forming loops 214*a*, 214*c* to facilitate enhanced brushing of the lingual and facial tooth surfaces with the dentifrice retained by loops 214*a, c*. The difference between the first height H1 of cleaning elements 207*a, c* and the second height H2 of cleaning elements 209 is preferably about 0.20–2.0 mm, but there could be other variations. Central cleaning element 207*b* is taller than cleaning elements 209 forming central loop 214*b* to facilitate better interproximal cleaning as well as cleaning of the crowns of the molars. The difference between the third height H3 of cleaning element 207*b* and the second height H2 of cleaning elements 209 is preferably about 0.20–2.0 mm, but other variations could be used. While this construction is preferred to maximize the cleaning of various surfaces in the mouth, other variations in the heights of the cleaning elements could be used as desired. For example, central cleaning elements 207 could all have the same heights with each other and as loop cleaning elements 209, or have heights that are higher or lower than the loop cleaning elements in different ways. In another example, the central cleaning elements 209 may have heights that are higher than the loop cleaning elements 209 in a staple configuration of toothbrush 100.

Head 105 also includes distal cleaning elements 203*a–b* at the free end 107. In the preferred construction, a pair of adjacent distal cleaning elements 203*a*, 203*b* straddle longitudinal axis a—a, although they could be formed by one or more than two cleaning elements. Distal cleaning elements 203*a–b* protrude higher from base surface 109 than the tips of the other tooth cleaning elements. The tips of each bristle tuft 203*a–b* collectively define an outermost cleaning surface 204 that is angled with respect to base surface 109 of head 105. By way of example, cleaning surface 204 is preferably at an angle Ø of about 30 degrees to base surface 109, but may also range between 10–50 degrees. It should be recognized that other angular values are possible. The extension and angular orientation of cleaning surface 204 of distal cleaning elements 203*a–b* better enable the user to reach and better clean the teeth in the back of the mouth. Cleaning elements 203*a–b* also can be used to dig into the crevices between the teeth and into the crown portions of the molars. Finally, as can been seen in FIG. 7, the outermost cleaning surface 204 also preferably is sloped laterally downward (to form a crowned surface) to assist in the removal of debris from the teeth.

Peripheral cleaning elements 205*a–c* are positioned near free end 107 and along each side 108 of head 105. These peripheral cleaning elements 205*a–c* are preferably formed by a plurality of bristle tufts that are arranged generally symmetrical with respect to the longitudinal axis a—a. Cleaning elements 205*a–c* are positioned rearward and laterally of distal cleaning elements 203*a–b*. Similarly, peripheral cleaning elements 215*a–c* are also positioned symmetrically about axis a—a along each side 108 near proximal end 111 of head 105. These two groups of cleaning elements 205*a–c*, 215*a–c* are generally mirror images of each other, but could have other constructions. Both the distal and proximal peripheral cleaning elements 205*a–c*, 215*a–c* are generally configured to enable the user to clean along the gum line and in the crevices between the teeth. In the illustrative embodiment, three bristle tufts form each group of peripheral cleaning elements 205*a–c*, 215*a–c*. Nevertheless, more or fewer bristle tufts in these groups may be used. Further, one or more elastomeric elements may be used to define the peripheral cleaning elements in place of or with the bristles.

Figure 3:
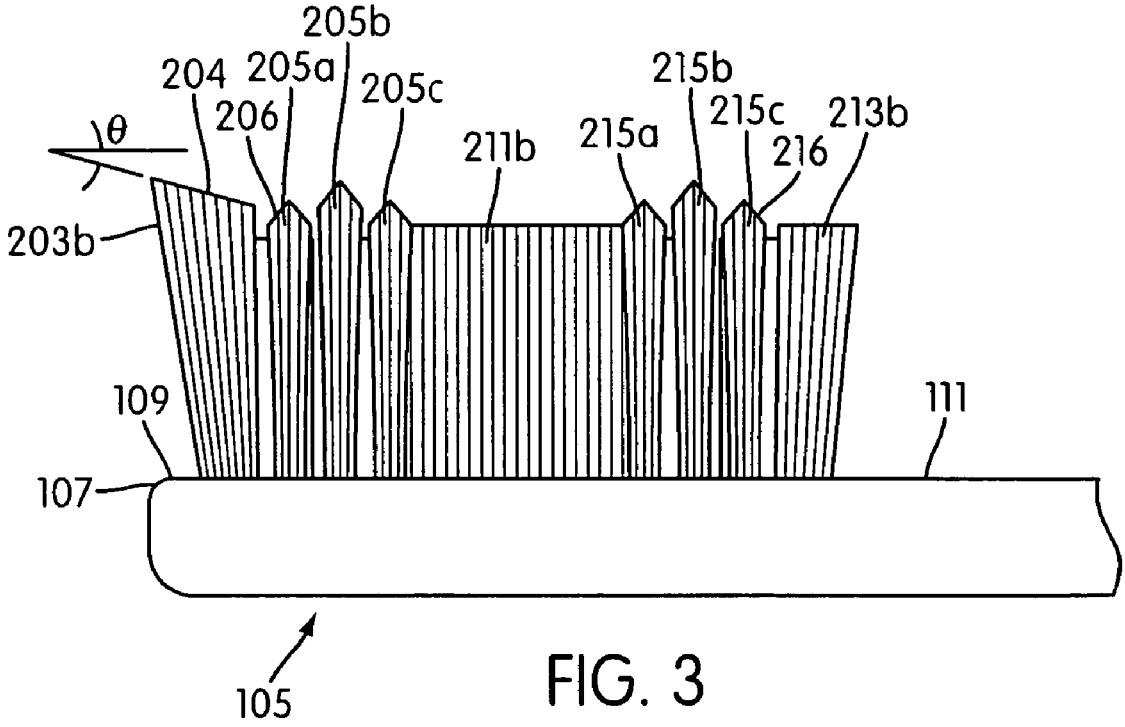
FIG. 3 is an enlarged side view of a head section of the toothbrush of FIG. 1.

As shown in FIG. 3, the tips of the peripheral cleaning elements 205*a–c* and 215*a–c* protrude higher from base surface 109 than the tips of the interior cleaning elements 207, 209, 211. In a preferred embodiment, two groups of peripheral cleaning elements 205, 215 are arranged along each side 108 of head 105. Each group of peripheral cleaning elements includes three generally aligned tufts of bristles, although other numbers of tufts could be used. The center tuft of cleaning elements 205*b*, 215*b* in each group of peripheral cleaning elements protrudes outward farther from base surface 109 than the others tufts 205*a*, 205*c*, 215*a*, 215*c*. This arrangement allows deeper engagement of the tooth surfaces along the gum line with cleaning elements 205*b* or 215*b*, while stimulating the gums with cleaning elements 205*a*, 205*c* and 215*a*, 215*c*. Moreover, each of the tufts has tapered ends 206, 216 to improve the cleaning of the interproximal areas and along the gum line.

Proximal cleaning elements 213*a–b* are positioned near the proximal end 111 of head 105. Preferably a pair of bristle tufts straddle longitudinal axis a—a, but one or more than two cleaning elements could be formed at the proximal end of the head. These proximal cleaning elements 213*a,b* are preferably defined by bristle tufts, but could also include or be defined by one or more elastomeric members.

The inventive aspects may be practiced for a manual toothbrush or a powered toothbrush. In operation, the previously described features, individually and/or in any combination, improves cleaning performance of toothbrushes. These advantages are also achieved by the cleaning elements and the synergistic effects. While the various features of the toothbrush 100 work together to achieve the advantages previously described, it is recognized that individual features and sub-combinations of these features can be used to obtain some of the aforementioned advantages without the necessity to adopt all of these features. This unique combination of elements gives exceptional cleaning power in a compact head space.

While the invention has been described with respect to specific examples including presently preferred modes of carrying out the invention, those skilled in the art will appreciate that there are numerous variations and permutations of the above described systems and techniques. Thus, the spirit and scope of the invention should be construed broadly as set forth in the appended claims.

What is claimed is:

1. A toothbrush comprising:

a handle;

a head coupled to the handle and including a base surface, and a pair of opposite side edges; and a plurality of tooth cleaning elements extending from the base surface of the head, the tooth cleaning elements including:

a first plurality of elastomeric walls that collectively define a first substantially closed loop, each elastomeric wall having a concave surface and separated from an adjacent elastomeric wall in the first plurality of elastomeric walls by a gap, the first substantially closed loop having a first center generally equidistant from the concave surface of each of the elastomeric walls of the first plurality of elastomeric walls;

a first central cleaning element of bristles disposed within the first substantially closed loop;

a plurality of arcuate-shaped cleaning elements of bristles that collectively define an outer loop, each arcuate-shaped cleaning element having an inner concave surface defining at least an inner portion of the outer loop and an outer convex surface defining at least an outer portion of the outer loop, each arcuate-shaped cleaning element separated from an adjacent arcuate-shaped cleaning element by a gap, the outer loop having a second center generally equidistant from each of the concave surfaces of each of the arcuate-shaped cleaning elements, wherein the first center and the second center are generally concentric.

2. The toothbrush according to claim 1, wherein the head further includes a longitudinal axis, and the tooth cleaning elements further comprising:

a second plurality of elastomeric walls that collectively define a second substantially closed loop, each elastomeric wall in the second plurality of elastomeric walls having a concave surface and separated from an adjacent elastomeric wall in the second plurality of elastomeric walls by a gap, the second substantially closed loop having a third center generally equidistant from each of the elastomeric walls of the second plurality of elastomeric walls, wherein the third center is disposed adjacent to the first center and the second center, along the longitudinal axis; and a second central cleaning element of bristles disposed within the second substantially closed loop.

3. The toothbrush according to claim 2, wherein the first central cleaning element has a first height defined from the base surface and the first plurality of elastomeric walls has a second height defined from the base surface, the first height and the second height being different.

4. The toothbrush according to claim 3, wherein the first height is above the second height.

5. The toothbrush according to claim 3, in which the plurality of arcuate-shaped cleaning elements have a third height defined from the head, the third height being above the second height.

6. The toothbrush according to claim 5, wherein the second plurality of elastomeric walls has a fourth height defined from the base surface and the second central cleaning element has a fifth height defined from the base surface, the fourth height and the fifth height being different.

7. The toothbrush according to claim 6 wherein the fifth height is below the fourth height.

8. The toothbrush according to claim 5 wherein the second plurality of elastomeric walls has a fourth height defined from the base surface and the second central cleaning element has a fifth height defined from the base surface, the fourth height being about the same as the fifth height.

9. The toothbrush according to claim 2, wherein the tooth cleaning elements further comprise at least one group of peripheral tooth cleaning elements of bristle tufts along each side edge of the head and disposed adjacent and lateral to the second substantially closed loop, each said peripheral tooth cleaning element extending farther from the base surface than the second plurality of elastomeric walls, and each said group of peripheral tooth cleaning elements including at least three adjacent peripheral cleaning elements, a central one of the adjacent peripheral tooth cleaning elements extending farther from the base surface than end ones of the adjacent peripheral tooth cleaning elements.

10. The toothbrush according to claim 9 wherein at least one of the peripheral tooth cleaning element has a tapered tip.

11. The toothbrush according to claim 1 wherein each of the arcuate-shaped cleaning elements of bristles of the plurality of arcuate-shaped cleaning elements of bristles is a continuous group of bristles.

12. The toothbrush according to claim 1, in which the tooth cleaning elements further include at least one distal cleaning element of bristles at a free end of the head, and the distal cleaning element extends farther from the base of the head than the elastomeric walls and the arcuate-shaped cleaning elements of bristles.

13. The toothbrush according to claim 12, in which the distal cleaning element defines an outer cleaning surface facing generally away from the head, wherein the outer cleaning surface is at an acute angle to the head and in which the outer cleaning surface slopes laterally away from a longitudinal axis of the head.

14. The toothbrush according to claim 12 in which the tooth cleaning elements further include at least one proximal cleaning element of a continuous tuft of bristles disposed near where the head couples to the handle.

15. A toothbrush comprising:

a handle;

a head coupled to the handle; and a plurality of tooth cleaning elements extending from the head, the tooth cleaning elements including a first set of cleaning elements and a second set of cleaning elements, each of said sets including a plurality of arcuate cleaning elements arranged with generally opposing concave surfaces facing each other, said sets being generally concentric to each other and a central cleaning element disposed in about the center of the arcuate cleaning elements.

16. The toothbrush according to claim 15, in which the arcuate tooth cleaning elements are elastomeric wall members.

17. The toothbrush according to claim 16, in which the arcuate tooth cleaning elements define a substantially closed loop about the central cleaning element.

18. The toothbrush according to claim 15, in which the arcuate tooth cleaning elements are a continuous tuft of bristles.

19. The toothbrush according to claim 15 wherein the tooth cleaning elements further include at least one group of peripheral cleaning elements along each side of the head.

20. The toothbrush according to claim 19 wherein each said peripheral cleaning element is a tuft of bristles with a tapered tip.

21. The toothbrush according to claim 20 in which each group of said peripheral cleaning elements includes at least three adjacent peripheral cleaning elements, wherein a central one of the adjacent peripheral cleaning elements projects farther from the head than end ones of the adjacent peripheral cleaning elements.

22. A toothbrush comprising:

a handle;

a head coupled to the handle, the head including a base surface; and a plurality of tooth cleaning elements extending from the base surface of the head, the tooth cleaning elements including:

an outer loop comprising a plurality of arcuate-shaped bristle tufts, each arcuate-shaped bristle tuft having a concave surface defining an internal side of the outer loop and a convex surface defining an external side of the outer loop, and separated from an adjacent arcuate-shaped bristle tuft of the plurality of arcuate-shaped bristle tufts by an outer loop gap;

a first substantially closed loop being disposed within the outer loop, the first substantially closed loop including a first plurality of elastomeric arc segments, each elastomeric arc segment having a convex surface and being separated from an adjacent elastomeric arc segment of the first plurality of elastomeric arc segments by a first loop gap, in which at least one first loop gap faces the concave surface of an arcuate-shaped bristle tuft of the outer loop; and a fluid pathway being defined between the convex surface of the first substantially closed loop and the concave surface of the outer loop for allowing a fluid to flow therein.

23. The toothbrush according to claim 22 wherein the first substantially closed loop includes two sets of opposing first loop gaps, the tooth cleaning elements further including a bristle tuft disposed within the first substantially closed loop and between the opposing sets of the first loop gaps.

24. The toothbrush according to claim 22 wherein the at least one first loop gap is unaligned with an outer loop gap.

25. The toothbrush according to claim 22 wherein the first substantially closed loop defines an interior region, the interior region being in fluid communication with the fluid pathway via the least one first loop gap.

26. The toothbrush according to claim 22 further comprising a first central bristle tuft disposed within the first substantially closed loop, wherein each elastomeric arc segment has a first height extending from the base surface and each arc segment has a top surface above the base surface, and each arcuate-shaped bristle tuft has a second height extending from the base surface, the first height being below the second height.

27. The toothbrush according to claim 26, wherein a generally cylindrical cavity is defined by the top surfaces of the elastomeric arc segments and the concave surfaces of each arcuate-shaped bristle tuft of the outer loop.

28. The toothbrush according to claim 22 further comprising:

a second substantially closed loop including a second plurality of elastomeric arc segments, each elastomeric arc segment of the second plurality of elastomeric arc segments having a concave surface, a convex surface and separated from an adjacent elastomeric arc segment of the second plurality of elastomeric arc segments by a second loop gap, wherein at least one second loop gap is generally aligned on an axis with at least one first loop gap of the first substantially closed loop.

29. The toothbrush according to claim 28 further comprising a first central bristle tuft disposed within the first substantially closed loop and generally disposed on the axis.

30. The toothbrush according to claim 29 further comprising a second central bristle tuft disposed within the second substantially closed loop, the second bristle tuft being generally disposed on the axis.

31. The toothbrush according to claim 29 wherein head includes a pair of side edges, wherein the tooth cleaning elements further include at least one group of peripheral cleaning elements along each side of the head.

32. The toothbrush according to claim 31 in which each group of peripheral cleaning elements includes at least three adjacent peripheral cleaning elements, wherein a central one of the adjacent peripheral cleaning elements extends farther from the head than end ones of the adjacent peripheral cleaning elements.

33. The toothbrush according to claim 22 wherein each arcuate-shaped bristle tuft is a continuous group of bristles.

* * * * *